US005546758A

United States Patent [19]

Hintermeier

[11] Patent Number: 5,546,758

[45] Date of Patent: Aug. 20, 1996

[54] CONTAINER

[76] Inventor: Heinrich Hintermeier, Brunnlettbert 28, D-92287 Schmidmuhlen, Germany

[21] Appl. No.: 314,492

[22] Filed: Sep. 28, 1994

[51] Int. Cl.[6] ..... F25D 23/12; B65D 88/00

[52] U.S. Cl. ..... 62/259.1; 62/298; 220/1.5; 220/4.28

[58] Field of Search ..... 62/298, 259.1, 62/263, 457.1; 220/1.5, 4.28

[56] References Cited

U.S. PATENT DOCUMENTS

| | | | |
|---|---|---|---|
| 3,205,674 | 9/1965 | Arnold et al. | 62/259.1 |
| 3,589,547 | 6/1971 | Hambleton | 220/4.28 |
| 3,889,486 | 6/1975 | Hinckley et al. | 62/62 |
| 4,776,484 | 10/1988 | Hansen | 220/345 |
| 4,893,478 | 1/1990 | Kruck et al. | 62/126 |
| 5,245,838 | 9/1993 | Cavalea | 62/259.1 |
| 5,253,776 | 10/1993 | Decroix et al. | 220/495 |
| 5,449,081 | 9/1995 | Sjostedt et al. | 220/1.5 |

FOREIGN PATENT DOCUMENTS

| | | | |
|---|---|---|---|
| 2062355 | 9/1992 | Canada | 220/4.28 |
| 0070800 | 1/1983 | European Pat. Off. . | |
| 2109666 | 9/1970 | Germany . | |
| 8630333 | 1/1987 | Germany . | |

*Primary Examiner*—William Doerrler
*Attorney, Agent, or Firm*—Hoffman, Wasson & Gitler

[57] ABSTRACT

The invention pertains to a novel design of a container consisting of wall elements bordering a container interior space, which form at least one front element, two side elements, at least one rear element, at least one cover element, and at least one bottom element, and which are detachably connected to one another by connecting pieces.

7 Claims, 9 Drawing Sheets

CONTAINER

BACKGROUND OF THE INVENTION

The invention pertains to a container including a plurality of wall elements bordering a container interior space, the wall elements include at least one front element, at least two side elements, at least one rear element and at least one bottom element. The elements are detachably connected to one another by connecting pieces. The front element includes a solid panel, and a swinging door. There is a provided a climate control unit on the front element. Thermal insulation is provided on the interior of the elements by placing a plurality of insulating plates thereon. The wall elements can be detached and stacked for transport.

In many areas of industry, containers which are set up at the respective sites of use are being used more and more for storing goods and products.

The object of the invention is to provide a container which is designed as a climatic or cooling container and is especially simple to handle and transport.

To achieve this object, a container is designed with the features outlined. That is it contains detachable wall elements, insulation and climate control features. Within the meaning of the invention, a "climatic container" is defined to mean a container whose interior space is kept at a preset temperature and/or humidity.

In particular, a climatic container within the meaning of the invention is a container with a cooling and/or heating unit.

A particular feature of the container, according to the invention, is the fact that the container is designed to be collapsible, that is, the broken-down container can be transported to the respective site of use in such a way that in the broken-down state the individual elements of the container are stacked one on top of the other, for example on the bottom element, so that only an extremely small transport volume is needed for shipping.

Another special feature of the container, according to the invention, is the fact that the climatic or cooling unit is located on the solid panel of the front element. This placement ensures that the climatic or cooling unit is always accessible for servicing and/or maintenance. Even in situations where the container is located in an area bordered by an enclosure or wall, accessibility of the climatic or cooling unit will not be impaired.

Solid panel here means a wall element which is solid when the container is in the operating state, but where it can also be stacked on the bottom element for transport.

Further developments of the invention are the object of the subclaims.

BRIEF DESCRIPTION OF THE DRAWINGS

The invention is explained in more detail below based on the figures referring to an embodiment. Here.

DETAILED DESCRIPTION OF THE INVENTION

Figure 1:
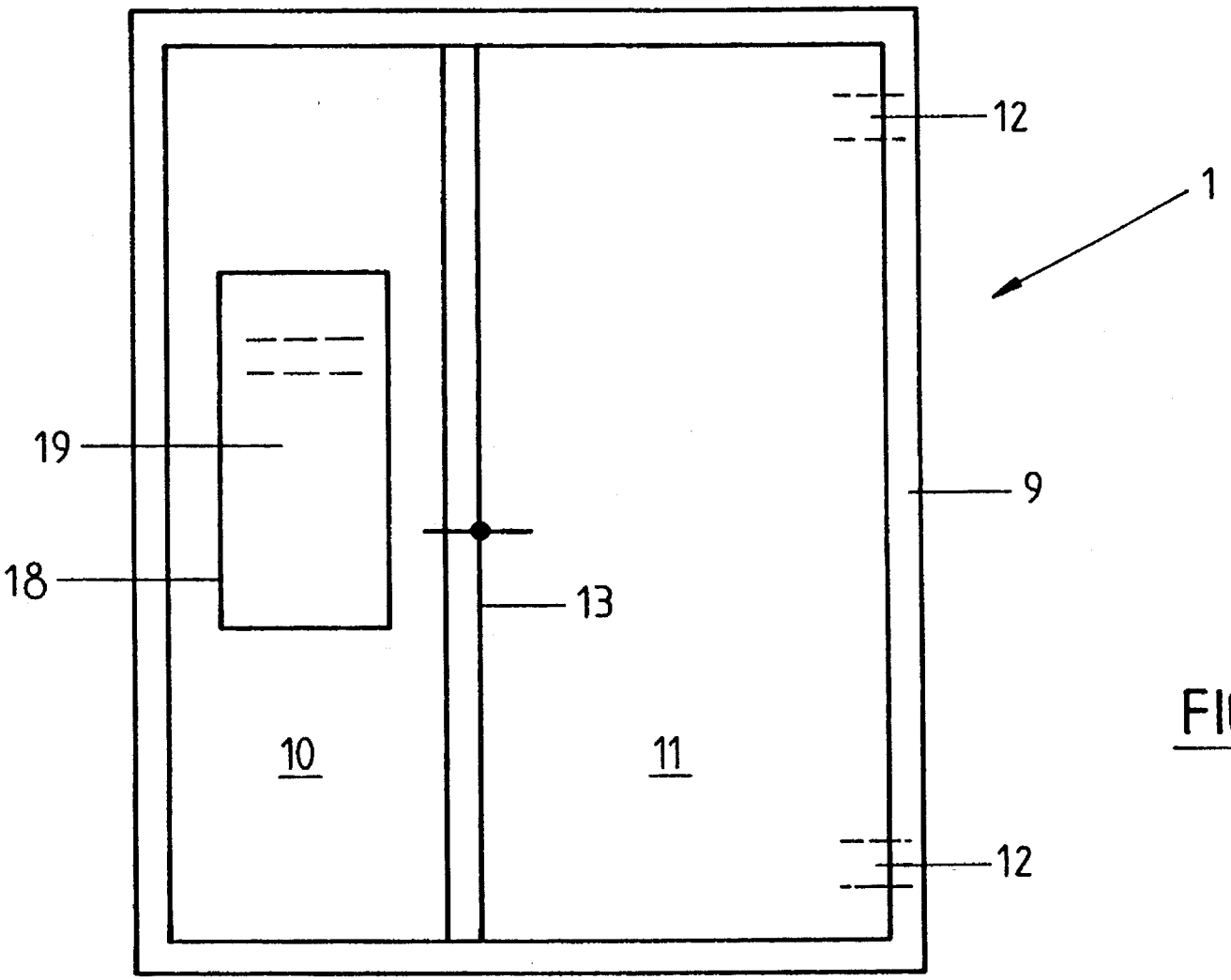
FIGS. 1 and 2 show climatic container in front view as well as in side view.
Figure 2:
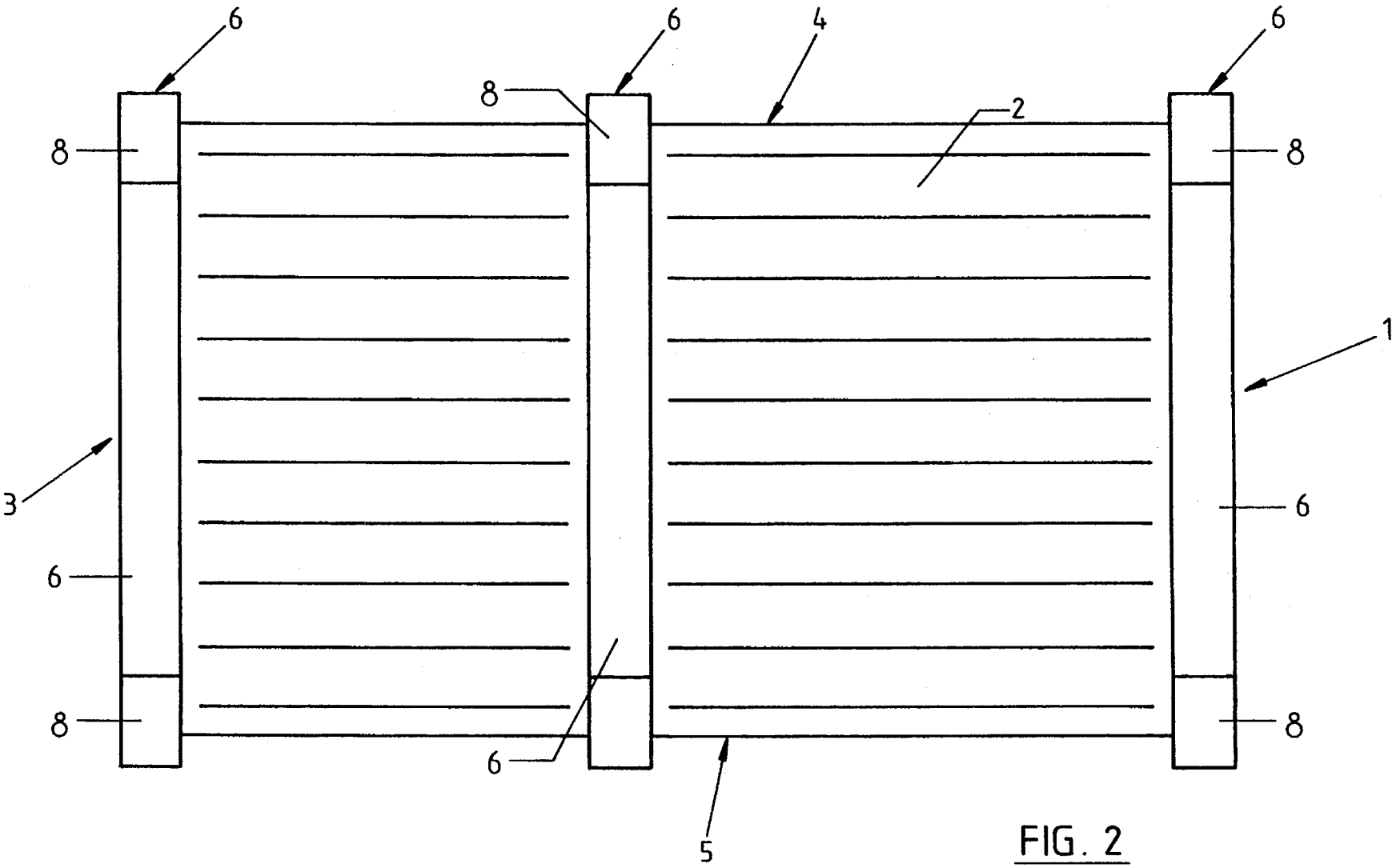

The climatic container depicted in the figures, which essentially resembles a parallelepiped, consists basically of a front element 1, of two side elements 2 which form the lengthwise sides of the container, of a rear element 3, of a cover element 4, and of a bottom element 5.

Side elements 2 and cover element 4 are wall elements which consist essentially of external struts 6 and sheets 7 which are shaped and are fastened to the struts. In the embodiment shown, straps 6 are galvanized hollow sections made of sheet steel. Steel sheets 7, which are also galvanized, have at least one trapezoidal indentation along its length. Struts 6 extend vertically at side elements 2 and horizontally at cover element 4 between two side elements 2. Sheets 7 are fastened in such a way that the latter lie perpendicular to struts 6 with the lengthwise extension of the shaping.

Struts 6 at side elements 2 and at cover element 4 and corresponding struts 6, located below, of bottom elements 5 are connected to one another via angular connecting pieces 8, in such a way that in each case a strut 6 is connected to a corresponding strap of each side element 2 and to a corresponding strap of bottom element 5 via connecting pieces 6 to form a self-contained strap arrangement or frame enclosing the interior space of the container, whose plane is arranged in the vertical direction.

Front element 1 of the container consists of an outer frame 9, which is held in the same way at side walls 2, cover element 4, and bottom element 5. The front element has a solid panel 10, which at its outer surface is formed in turn by shaped sheet 7, as well as a door 11, which is arranged to pivot around a vertical axis with the aid of hinges 12 on frame 9 and comprises a locking mounting 13 with which the door can be locked to frame 9 in the closed state.

Rear element 3 also consists of an outer frame as well as of shaped sheet 7, which is held in the vertical direction, for example with the lengthwise extension of its shaping. Rear element 3 is held by its frame at two side elements 2, at cover element 4, and at bottom element 5.

Bottom element 5 also consists, as indicated above, of struts 6 as well as of a tub 14 made from sheet-steel and fastened to these struts 6, which tub features Z-profiles 15 as spacers and stiffening elements projecting on its interior space over the bottom of the tub and extending over the entire length of the container. Between these profiles, which are arranged parallel to and separated from one another, tub 14 is filled with a thermally insulating material 16. A shaped metal plate 17 (fluted plate), which forms the accessible bottom surface of the container and is fastened in a suitable way to profiles 15, and rests on profiles 15.

Figure 3:
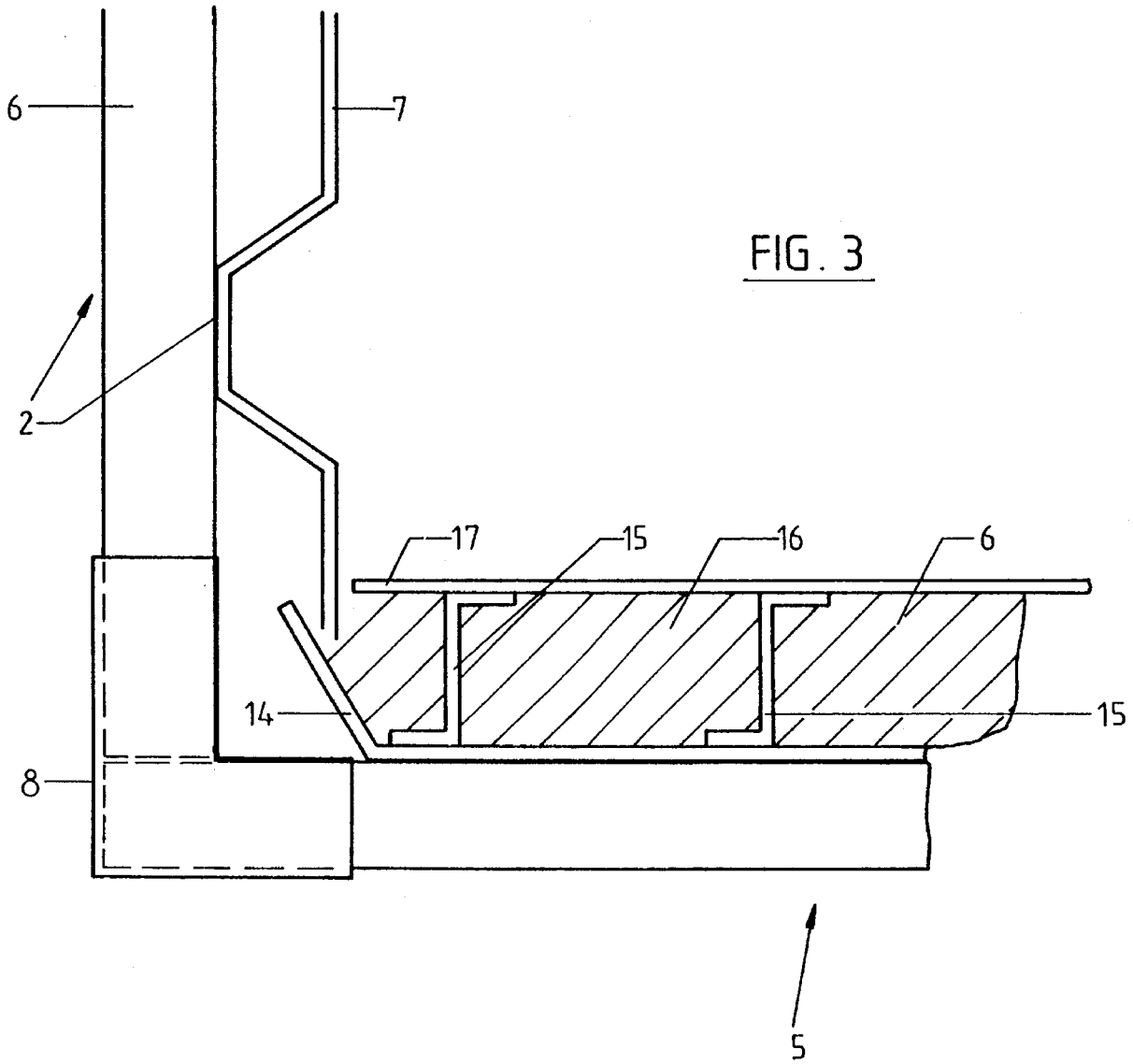
FIG. 3 show a partial section through a side wall as well as through the bottom of the climatic container of FIGS. 1 and 2.
Figure 4:
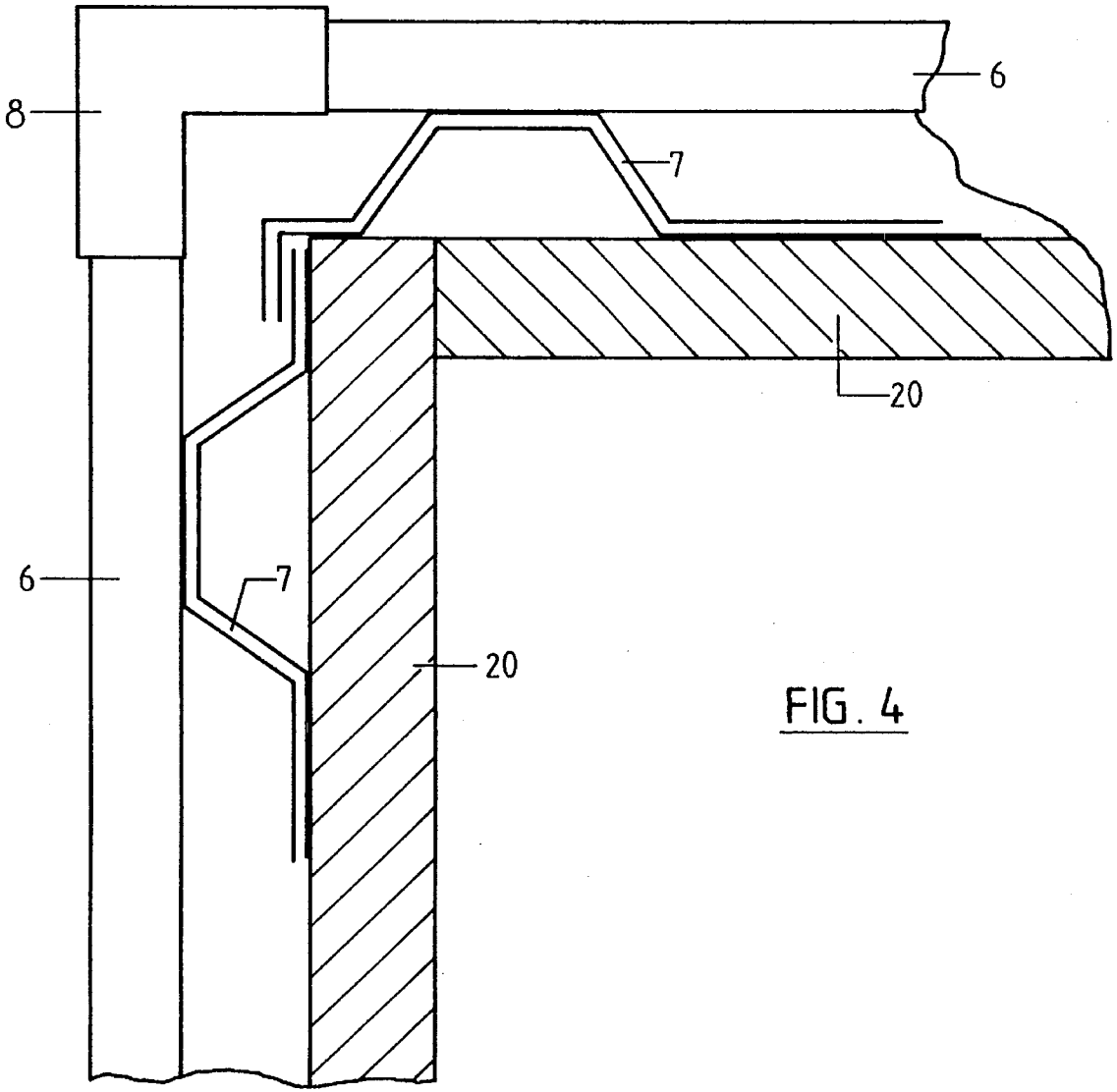
FIG. 4 shows a section similar to FIG. 3, but in the connecting area between a side wall and the cover container.
Figure 5:
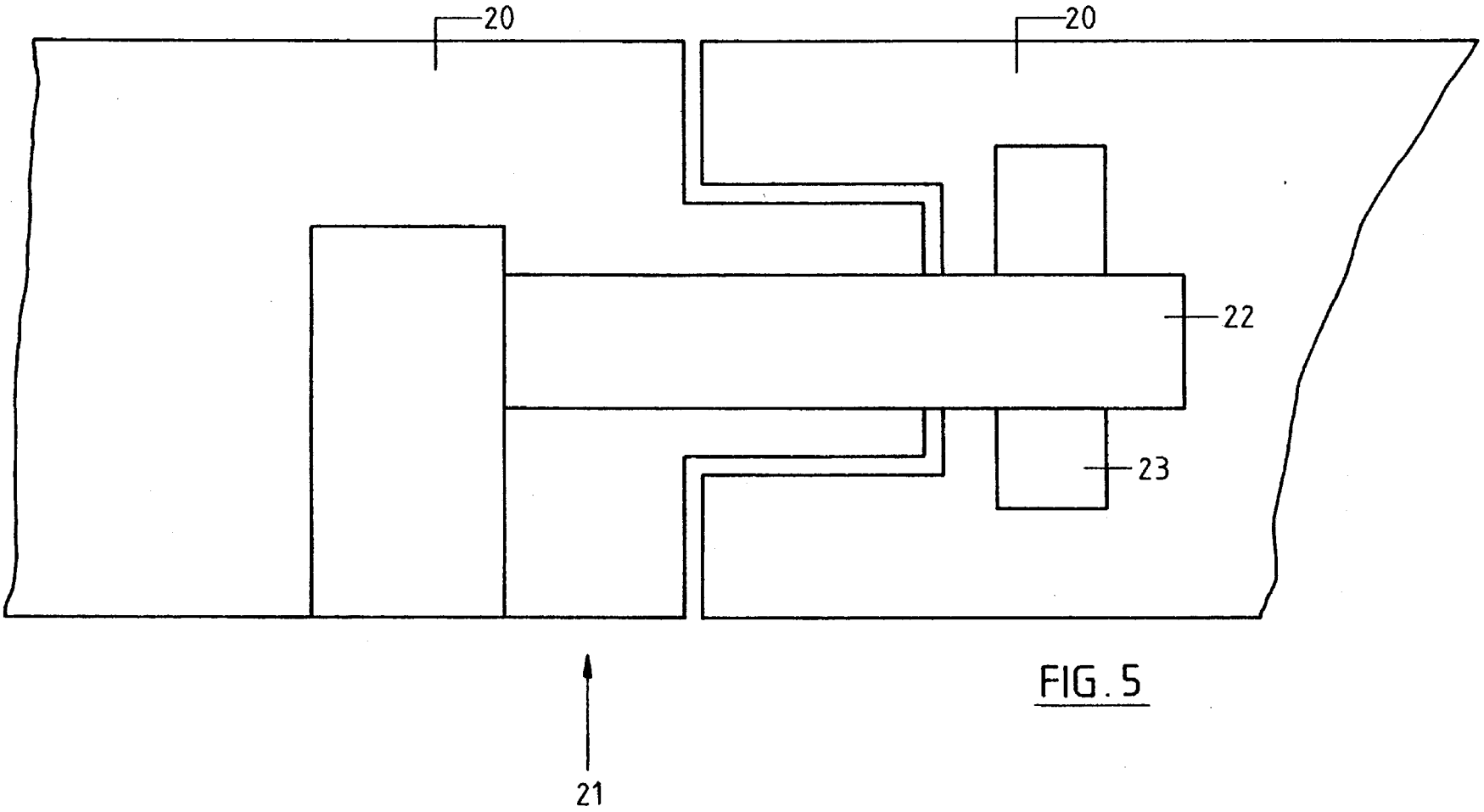
FIG. 5 shows two adjoining insulating plates of thermal insulation in simplified representation and in the horizontal section.
Figure 6:
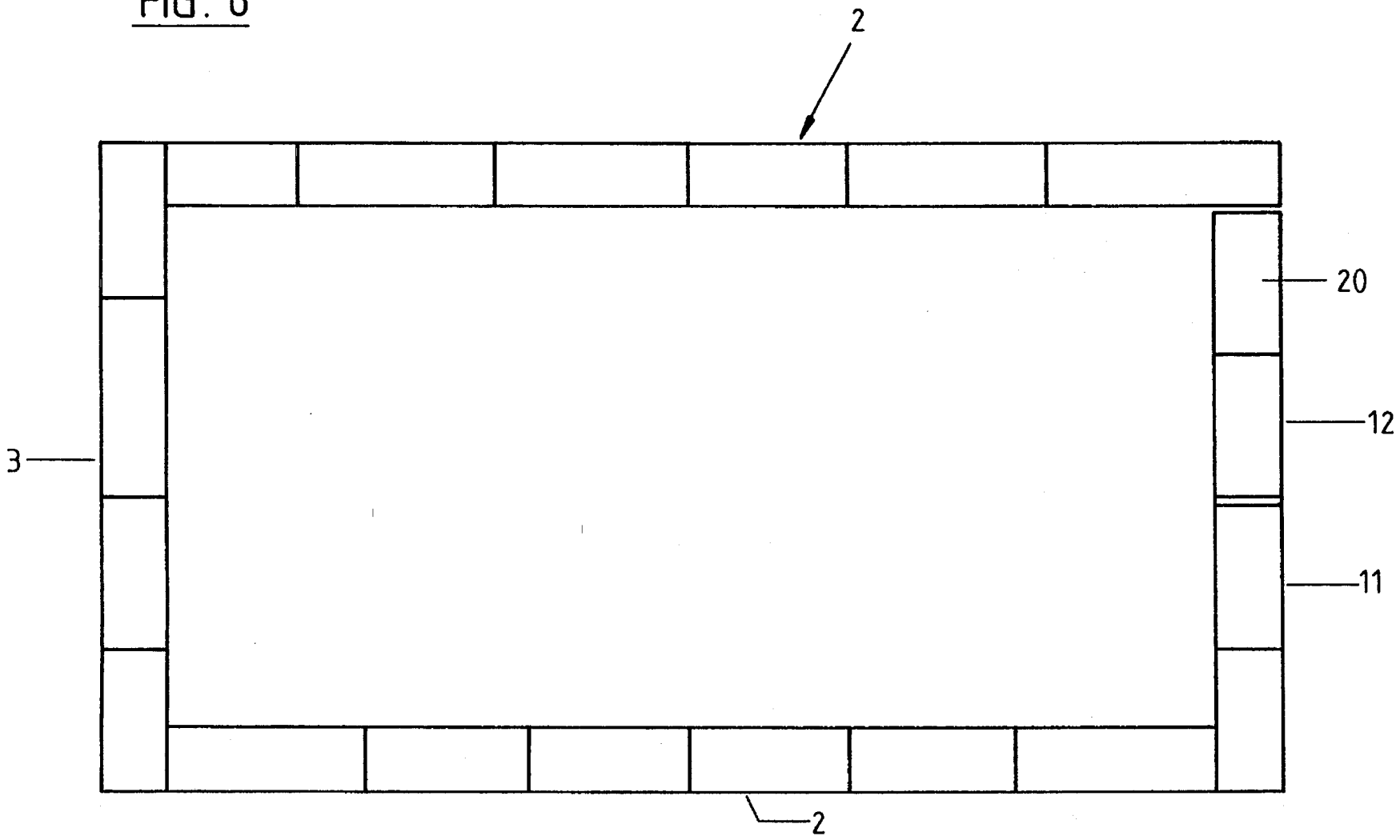
FIG. 6 shows a diagrammatic representation of the climatic container in outline.
Figure 7:
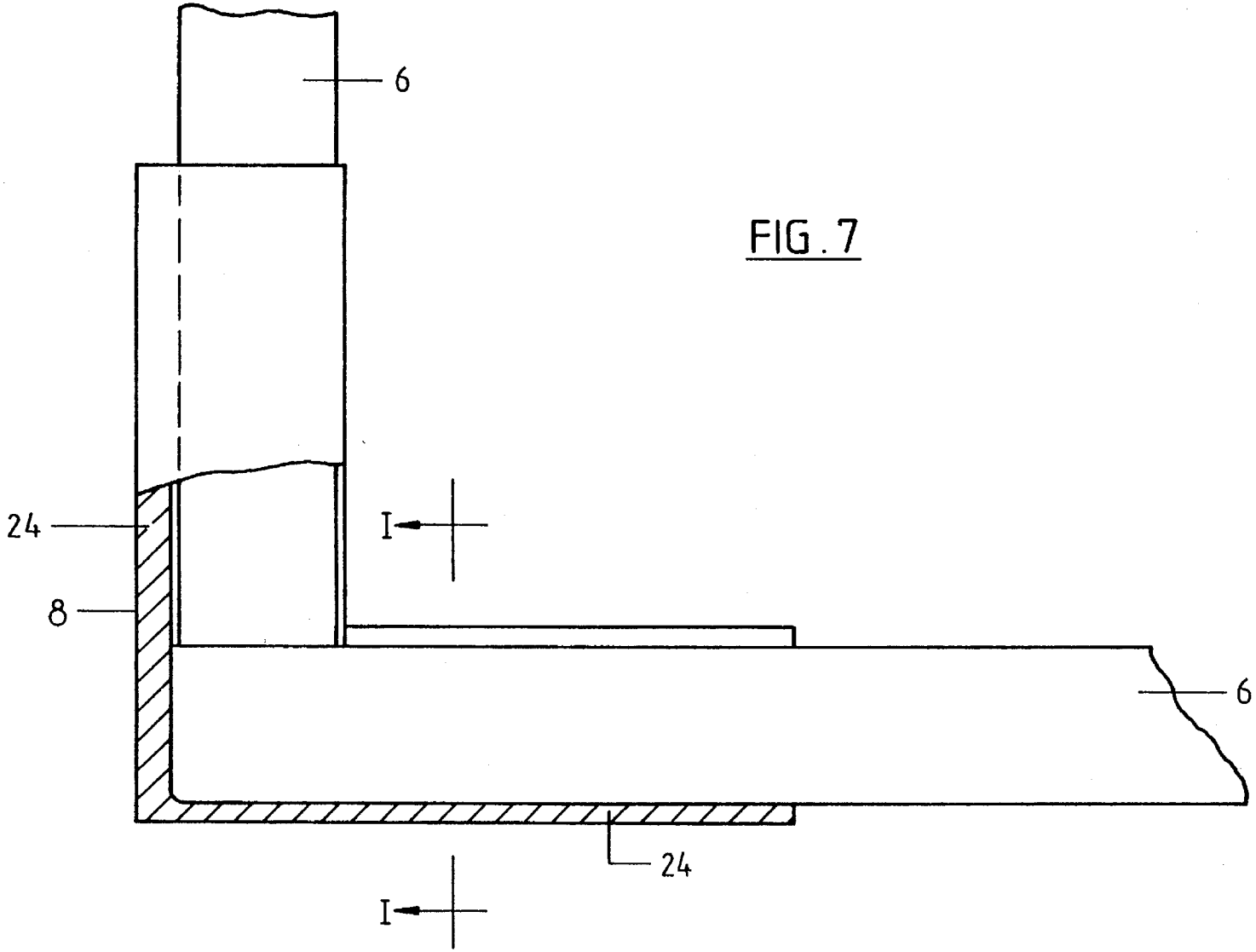
FIG. 7 shows in detailed representation a connection between two outside carrying straps of the container.

At its outer surface the container is tightly closed, particularly against moisture penetration, by sheets 7, and sheets 7 are bent at the transitions between the lower edges, especially side elements 2 and cover element 4 as well as at the transitions between the lower edges, especially side elements 2 and the bottom element, so that a drain is provided for rainwater to flow outside, which (drain) prevents water from penetrating into the container, as is clearly shown in FIGS. 3 and 4.

In solid panel 10 on front part 1 of the container is an opening 18 in which a climatic unit 19 (cooling unit) is installed in such a way that all servicing elements of this unit are located on the outside of front part 1 and thus of the container, while the evaporator that produces the cooling action as well as optional fans for producing an air current inside the container are provided on the inside of panel 10.

Figure 8:
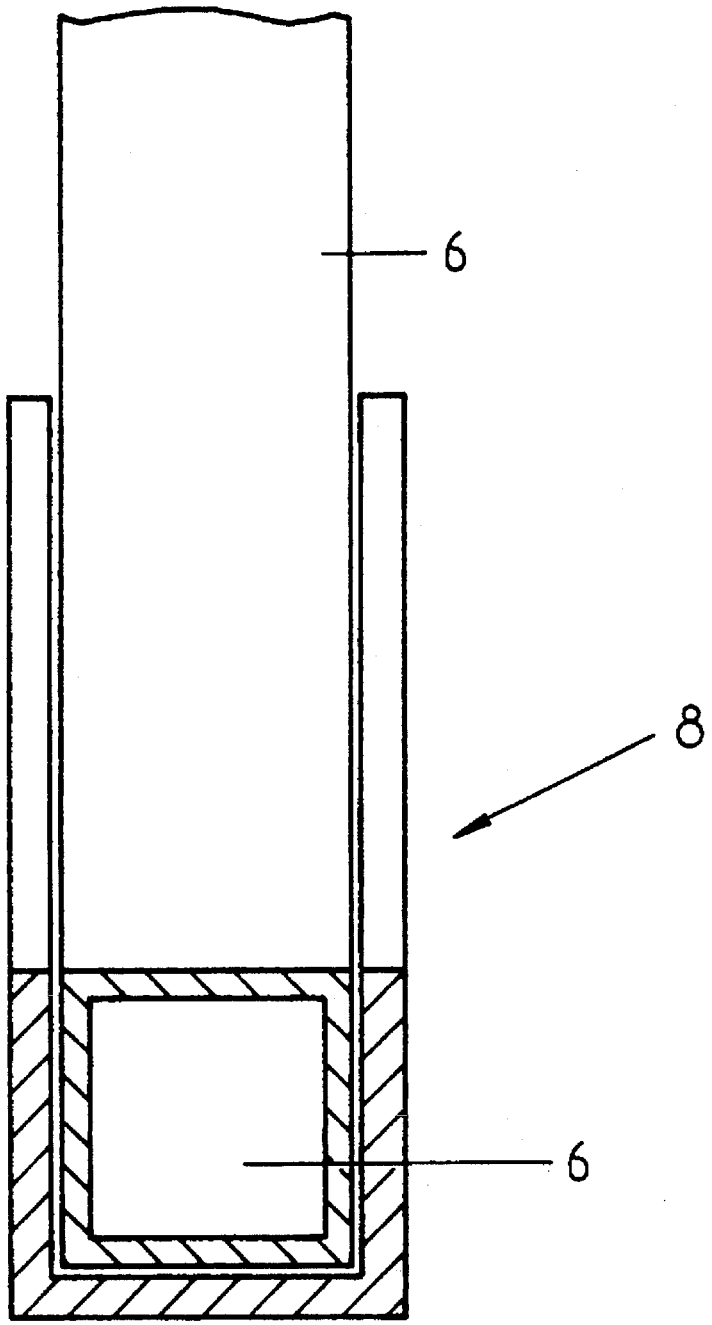
FIG. 8 shows a section corresponding to line I—I of FIG. 7.
Figure 9:
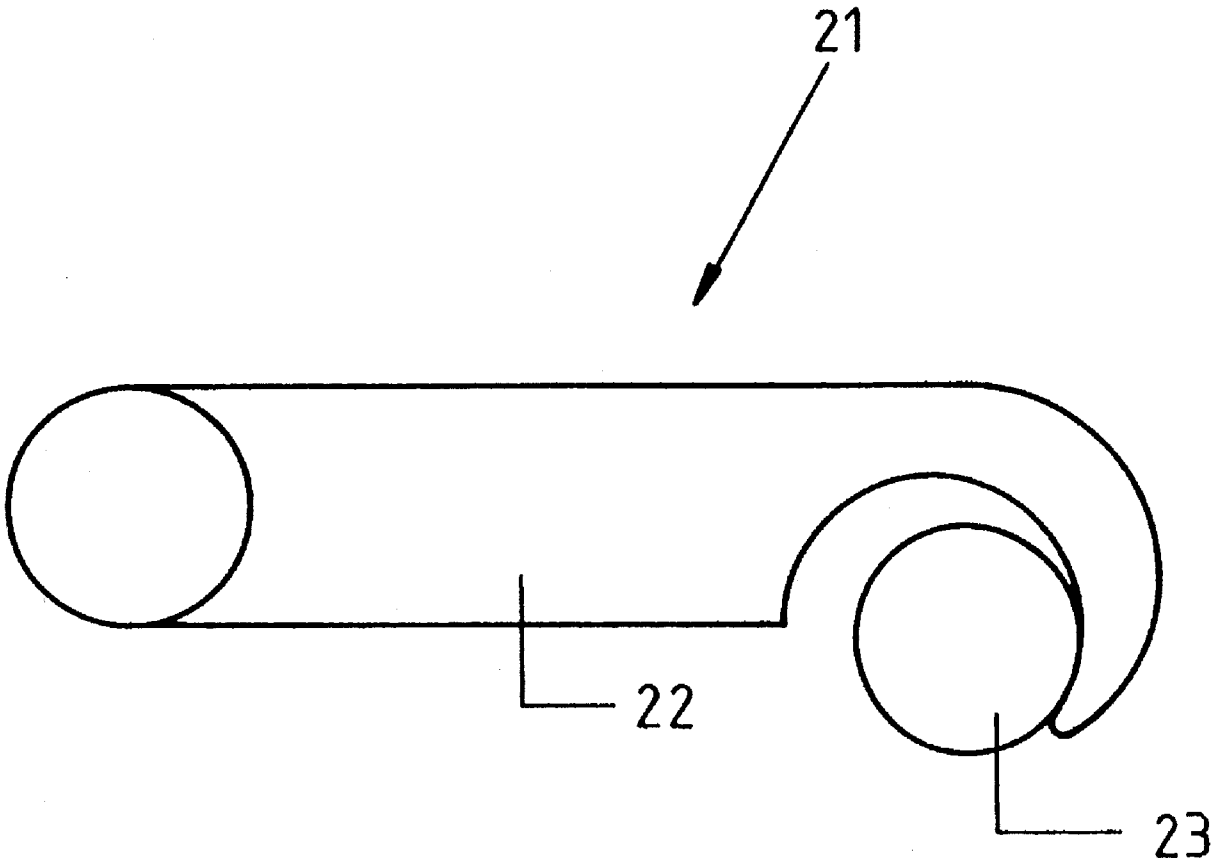
FIG. 9 shows in simplified diagrammatic operating representation a locking element for connecting two adjoining insulating plates.

On the insides of front element 1, of side elements 2, of rear element 3, and of cover element 4, thermal insulation is provided which consists of a large number of insulation plates 20 which adjoin one another, which are connected in each case to the element in question, and which at the transitions between them are connected in the form of a groove and spring. Because straps 6 which form the carrying elements are provided externally, insulating plates 20 can rest directly against sheets 7. In particular, no recesses in insulating plates 20 are needed for carrying elements of the container, etc.. Insulating plates 20 are in turn detachably fastened to the insides of elements 1–4 by connecting elements, not shown. Adjoining insulating plates 20 are also tightly connected to one another by closures 21. Closures 21 each consist of a hooklike closure element 22, which inside the respective insulating plate pivots or rotates around an axis running perpendicular to the surface sides of this insulating plate, as well as of a pinlike closure element 23, which is gripped from behind by the latter when the insulating plates are connected or when closure element 22 pivots. In this connection see FIG. 8.

Connecting pieces 8 each consist essentially of two U-profiles 24 which form a right angle to one another, each of which can be pushed from the outside onto one end of two struts 6 to be connected together, so that the respective profile encloses the strut end in question. The strap ends are then connected to the connecting piece 8 by screws or other suitable fastening means.

A special feature of the climatic container consists of the fact that it can be broken down for transport to the site of use in such a way that all elements of this container, i.e., front element 1, side elements 2, rear element 3, cover element 4, and insulating plates 20, can be stacked on bottom element 5 for shipping, so that the climatic container, despite having a large capacity when used for shipping, comprises an extremely small transport volume.

The invention was described above using an embodiment as an example. It is understood that numerous changes and modifications are possible, without going beyond the basic scope of the invention.

I claim:

1. A container comprising a plurality of wall elements bordering a container interior space, said wall elements including at least one front element, at least two side elements, at least one rear element, at least one cover element, and at least one bottom element, said wall elements being detachably connected to one another by connecting pieces, said front element comprises a non-opening solid panel, at least one swinging door, and at least one climatic or cooling unit attached to said non-opening solid panel of said front element, wherein all servicing elements of said climatic or cooling element is located on an outside of said non-opening solid panel, said non-opening solid panel of said front element, said container further comprising thermal insulation provided on inside surfaces of said container, said thermal insulation comprises a plurality of insulating plates which are detachably connected to one another and to said wall elements of said container, and wherein said container is collapsible, whereby said wall elements can be stacked together with said insulating plates on said an least one bottom element for transporting said container.

2. A container according to claim 1, wherein said at least two side elements and said at least one cover comprise external struts which form a carrying part or a carrying frame, to which at least one shaped sheet, is fastened to form a wall element.

3. A container according to claim 2, wherein said shaped sheet has at least one trapezoidal indentation.

4. A container according to claim 1, wherein said at least one bottom element comprises at least one tublike element which is fastened to at least one strap that is provided under said at least one bottom element, and wherein said thermal insulation is provided in said tublike element.

5. A container according to claim 3, further comprising a bottom plate which is held by spacers attached to said element.

6. A container according to claim 1 wherein said side elements, said at least one cover element, and said bottom element contain a plurality of external struts connected together by a second plurality of connecting pieces to form a closed, vertical, external carrying or strap frame.

7. A container according to claim 1, further comprising closure means for detachably connecting said insulating plates to one another as well as to the inside of said wall elements.

* * * * *